United States Patent [19]

Misevich

[11] Patent Number: 4,598,487

[45] Date of Patent: Jul. 8, 1986

[54] ATHLETIC SHOES FOR SPORTS-ORIENTED ACTIVITIES

[75] Inventor: Kenneth W. Misevich, Fairfield, Conn.

[73] Assignee: Colgate-Palmolive Company, New York, N.Y.

[21] Appl. No.: 589,411

[22] Filed: Mar. 14, 1984

[51] Int. Cl.[4] ..... A43B 13/18; A43B 7/32; A43B 13/00

[52] U.S. Cl. ..... 36/114; 36/28; 36/129; 36/136

[58] Field of Search ..... 36/92, 102, 28, 27, 36/38, 68, 114, 129, 32 R, 7.8, 31, 69

[56] References Cited

U.S. PATENT DOCUMENTS

| | | | |
|---|---|---|---|
| 1,132,096 | 3/1915 | Jaedike | 36/88 |
| 2,568,974 | 9/1951 | Tarbox | 36/43 |
| 4,255,877 | 3/1981 | Bowerman | 36/129 |
| 4,391,048 | 7/1983 | Lutz | 36/28 |
| 4,402,146 | 9/1983 | Parracho et al. | 36/129 |
| 4,430,810 | 2/1984 | Bente | 36/32 R |
| 4,459,765 | 7/1984 | Power | 36/114 |

*Primary Examiner*—Werner H. Schroeder
*Assistant Examiner*—Steven N. Meyers
*Attorney, Agent, or Firm*—Nies, Webner, Kurz & Bergert

[57] ABSTRACT

An athletic shoe wherein outward expansion of one or more portions of the shoe's foamed, closed cell polymeric midsole is constrained to increase the amount of energy absorbed by the midsole under a wearer-applied load. Various embodiments of this invention provide for the precompression of the constrained midsole portion to further enhance the midsole's energy-absorbing capability.

20 Claims, 36 Drawing Figures

Fig.8
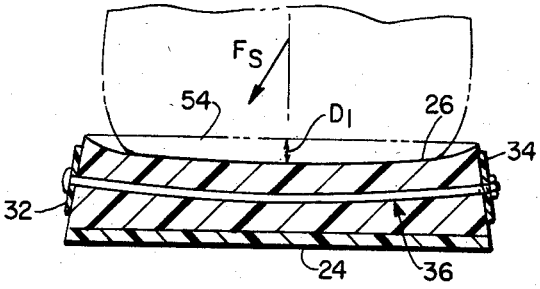
Fig.9
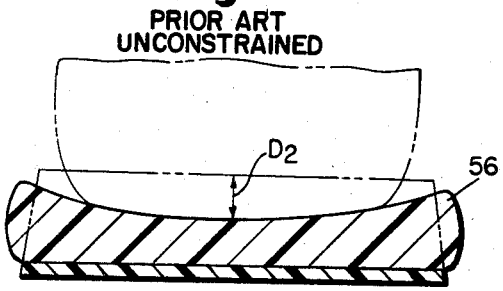
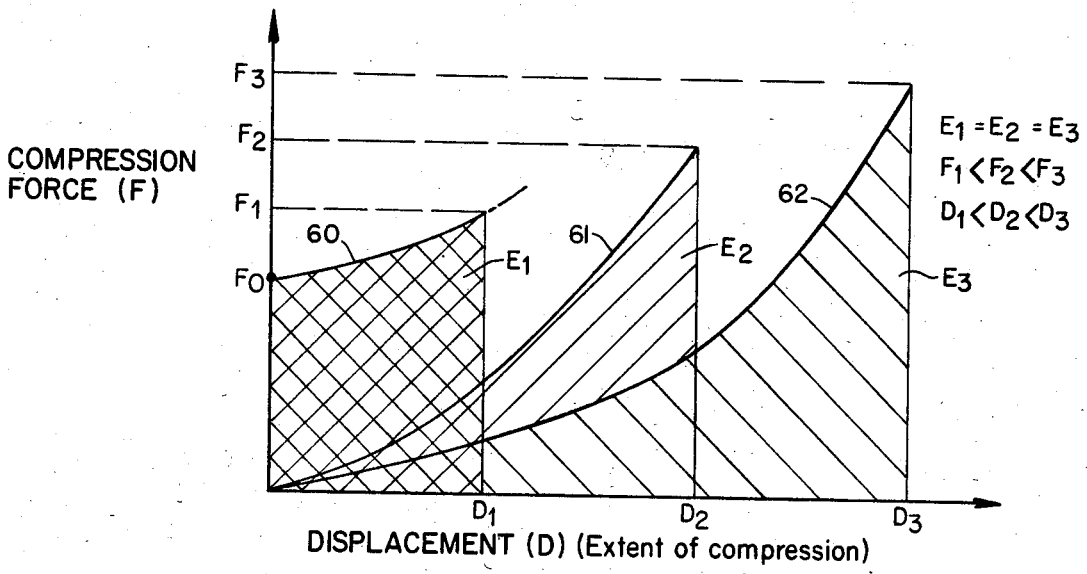
Fig.10
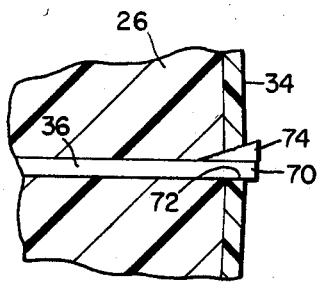
Fig.11
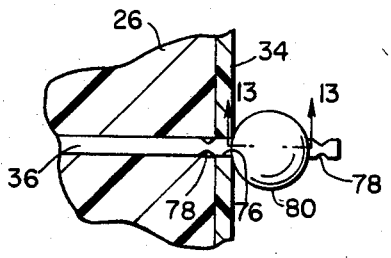
Fig.12
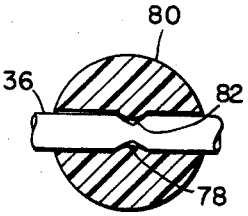
Fig.13

ATHLETIC SHOES FOR SPORTS-ORIENTED ACTIVITIES

FIELD OF INVENTION

This invention relates to athletic shoes of the type having a foamed, polymeric midsole for running, tennis and other sports-oriented activities.

BACKGROUND

Laminate sole structures for present day athletic shoes typically have a foamed, energy-absorbing intermediate sole (usually called a midsole) for cushioning the wearer's foot and for reducing the shock to the wearer's body. The foamed midsole is customarily of the closed cell type and is usually relatively soft to meet the wearer's comfort requirements. The softer the midsole is, however, the less efficacious it is for absorbing energy due to wearer imposed loads.

Various proposals have been made for enhancing the midsole's energy absorption capability. In one type of prior shoe, for example, the foamed midsole is formed with energy-absorbing pressurized air chambers. In another type of athletic shoe the midsole is provided with energy-absorbing plugs. Another type of shoe utilizes a neeting wrapped around the midsole's borders in an effort to stiffen the midsole. In yet another type of shoe, a foamed midsole core is bordered by a separately formed midsole border. None of these constructions is very effective for improving energy absorbance.

SUMMARY AND OBJECTS OF THE INVENTION

With the foregoing in mind, the general aim and purpose of this invention is to provide a novel athletic shoe structure in which the midsole's energy absorption capability is significantly improved. Various novel constructions are described herein for carrying out the subject invention.

In one embodiment, a pair of constraint plates or pads are interconnected through one or more transversely extending tie members and seat against opposite side edges of the midsole to constrain outward expansion of the midsole along selected regions of its side borders. The tie members may advantageously be pretensioned to compressively preload the midsole. With a closed cell midsole foam, the precompression of the midsole increases the midsole's internal, closed cell gas pressure, thus increasing the energy absorbed by the midsole upon initial penetration of the wearer's foot into the midsole.

In another embodiment, a central, oversized foamed core is precompressed into the opening of a midsole border. In yet another embodiment, the outsole is formed with an array of nubs which penetrate upwardly into and precompress portions of the overlying midsole. In still another embodiment, foamed midsole plugs are precompressed into holes in the foamed midsole body.

The present invention as summarized above has a number of advantages over known prior shoe constructions. First, it improves the energy-absorbing efficiency of the foamed midsole. Second, it can be adapted to provide a selective foot support to account for different running styles, variations in weight and running asymmetries. It also can be used to compensate for foot and/or leg asymmetries. The constraint plate embodiments of this invention have an additional advantage in that they can be applied to any athletic shoe after its manufacture and therefore can be used to customize shoes to an individual wearer.

In a further embodiment of this invention, a midsole sole stiffening plate is used as a tie member to interconnect the constraint plates on opposite sides of the midsole. The stiffening plate lies between upper and lower midsole layers and performs the additional function of stiffening a selected portion of the foamed midsole to reduce localized midsole degradation. Midsole stiffening plates of the foregoing type are described in the assignee's copending U.S. application Ser. No. 456,820 filed Jan. 20, 1983.

With the foregoing in mind, another important object of this invention resides in the provision of a novel device for constraining outward expansion of the foamed midsole or intermediate sole in an athletic shoe.

Yet another important object of this invention is to provide a novel athletic shoe sole structure in which a foamed intermediate sole is compressively preloaded to increase the internal gas pressure in the closed cells of the midsole foam.

Still another object of this invention resides in the provision of a novel midsole structure in which one or more portions of a foamed midsole structure are precompressed.

Further objects of this invention will appear as the description proceeds in connection with the below-described drawings and the appended claims.

DESCRIPTION OF DRAWINGS

FIG. 8 is a section similar to FIG. 3, but illustrating the midsole in its loaded condition;

FIG. 9 is a section similar to FIG. 8, but illustrating a conventional athletic shoe with an unconstrained foamed midsole;

FIG. 10 is a graph showing the energy absorbed by the constructions illustrated in FIGS. 8 and 9;

FIG. 11 is an enlarged fragmentary view similar to FIG. 5, but showing another type of fastening device for securing the constraint plate tie members;

FIG. 12 is an enlarged fragmentary view similar to FIG. 5, but showing yet another type of fastening device for securing the constraint plate tie members;

FIG. 13 is a section taken substantially along lines 13—13 of FIG. 12;

DETAILED DESCRIPTION

Figure 1:
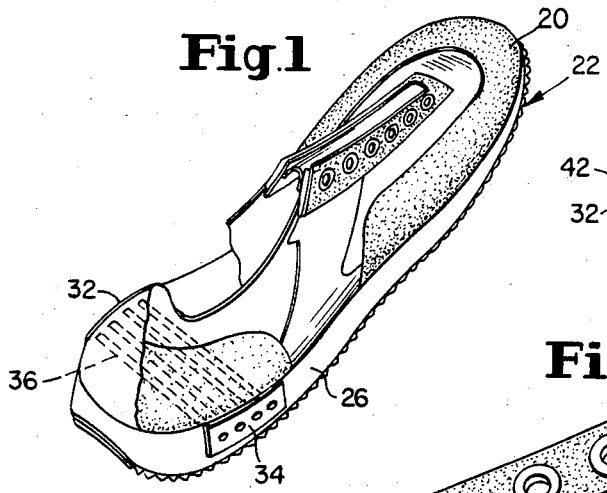
FIG. 1 is a perspective view of a right foot athletic shoe incorporating one embodiment of this invention.
Figure 3:
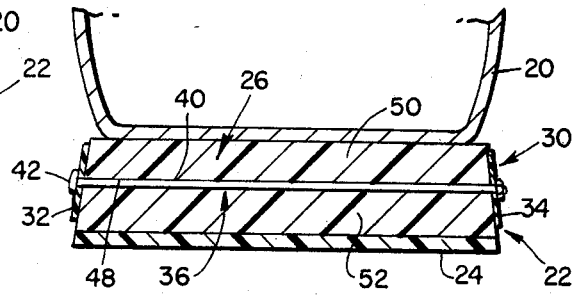
FIG. 3 is a section taken substantially along lines 3—3 of FIG. 2.
Figure 2:
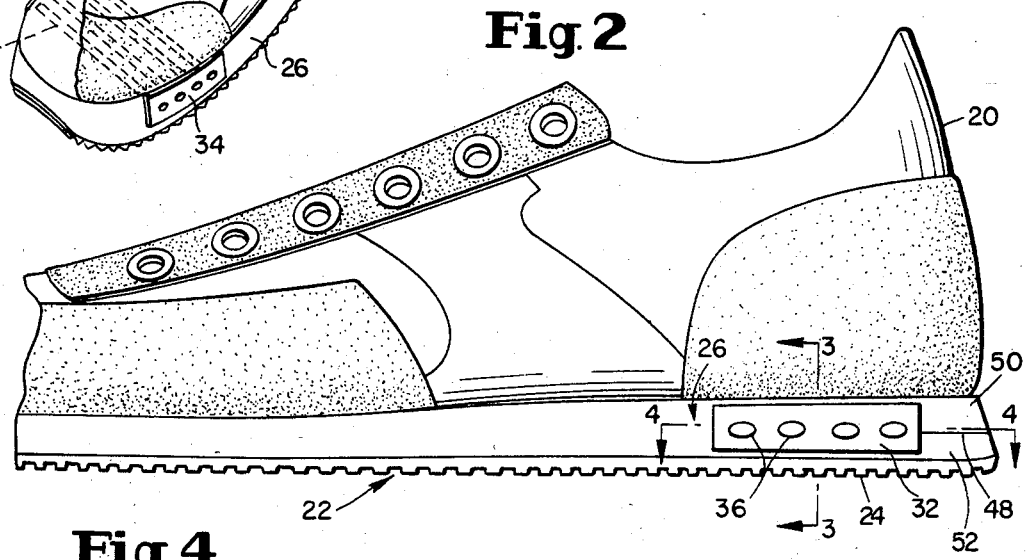
FIG. 2 is a fragmentary left side elevation of the athletic shoe shown in FIG. 1.

Referring to FIGS. 1-3, one embodiment of an athletic shoe incorporating the principles of this invention is shown to comprise a flexible upper 20 and a laminate bottom or sole unit 22 underlying the upper 20. Upper 20 may be of a suitable conventional construction. In this embodiment, upper 20 is of the sliplasted type having a closed fabric bottom such that the upper extends completely around the wearer's foot like a slipper. Alternatively, upper 20 may be of the boardlasted type having an open bottom which is closed by an insole board.

Sole unit 22 comprises a flexible, elastically deformable ground-engaging outsole 24, and a foamed, flexible, energy-absorbing midsole or intermediate sole 26 overlying and bonded to outsole 24. Midsole 26 has a heel wedge portion 28 under the wearer's heel. Upper 20 is bonded to or otherwise suitably fixed to midsole 26. Heel wedge portion 28 is optional.

Heel wedge portion 28 may alternatively be formed separately of midsole layer 26. In either case, heel wedge portion 28 is considered to be part of the foamed midsole structure.

Outsole 24 is molded from any suitable resilient, tough synthetic or natural rubber material which is preferably highly resistant to wear. Midsole 26 is formed from any suitable, lightweight closed cell polymeric foam. For example, midsole 26 may be formed from a blend of ethylene vinyl acetate and polyethylene and then cross-linked with a peroxide during molding.

As shown in FIGS. 1-4, sole unit 22 is equipped with a midsole constraint mechanism 30 for constraining outward expansion of midsole 26. Constraint mechanism 30 comprises a pair of opposed stiff constraint plates or pads 32 and 34 and a preselected number of flexible, nonstretchable tie members 36 interconnecting plates 32 and 34. Preferably, two or more tie members are employed. In the embodiment shown in FIGS. 1-4, there are four tie members in the region underlying the wearer's heel or rearfoot.

Plates 32 and 34 may be formed from any suitable plastic material. Tie members 36 also may be formed from any suitable plastic material.

Constraint plates 32 and 34 are disposed on opposite sides of midsole 26 in the rearfoot or heel region of the shoe and interfittingly seat against the midsole's oppositely facing medial and lateral side edges. Tie members 36 extend transversely through midsole 26 between plates 32 and 34 are secure plates 32 and 34 together. Upon compressing midsole 26, tie members 36 are placed in tension to prevent displacement of plates 32 and 34 away from each other, thereby constraining outward expansion of midsole 26.

In the embodiment shown in FIGS. 1-6, constraint plates 32 and 34 are rectangular, are of equal sizes and extend coextensively on opposite sides of midsole 26. Plates 32 and 34 may be bonded or adhered to midsole 26.

Figure 4:
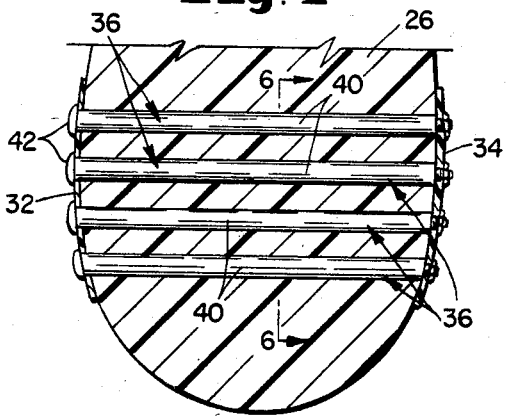
FIG. 4 is a section taken substantially along lines 4—4 of FIG. 2.

As shown in FIGS. 3 and 4, each of the tie members 36 is formed with a body portion 40, terminating at one end in an enlarged head 42 and at the other end in a threaded end section 44. The body portion 40 of each tie member 36 extends through an aperture in constraint plate 32 such that the head 42 of the tie member seats against the outwardly facing surface of constraint plate 32.

Figure 5:
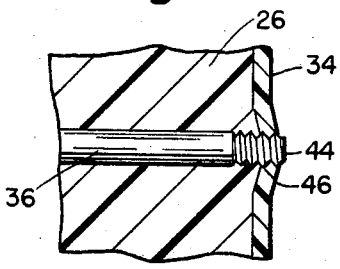
FIG. 5 is an enlarged fragmentary view of the section shown in FIG. 4.

As best shown in FIG. 5, the threaded end section 44 of each tie member is securely threaded into a separate Tinnerman type nut portion 46 which is formed integral with constraint plate 34. Each nut portion 46 is formed with a pair of spring arms which define an aperture for threadedly receiving end section 44.

In the embodiment of FIGS. 1-6, the body portions 40 of tie members 36 are flat-sided in the form of strips or ribbons and lie flat along a common horizontal plane intersecting midsole 26 about midway between its upper and lower surfaces. In this embodiment, the longitudinal axes of tie members 36 are uniformly sapced apart, are parallel and extend normal to the shoe's rearquarter axis. Tie members 36 may alternatively be in the form of fibers, filaments, wires or rods of circular cross section.

In the embodiment shown in FIGS. 1-6, tie members 36 are formed separately of and are detachable from constraint plates 32 and 34. Alternatively, tie members 36 may be formed integral with one of the constraint plates and detachably secured by any suitable fastening device to the other of the constraint plates.

From the description thus far it will be appreciated that upon compression of midsole 26, plates 32 and 34 are held in place by tie members 36 to constraint outward expansion of the midsole in the rearfoot region. Tie members 36 are selectively adjustable to precompress midsole 26 by a selected magnitude. Alternatively, tie members 36 may be adjusted to just snugly seat plates 32 and 34 against midsole 26 without precompressing the midsole.

In the embodiment shown in FIGS. 1–6, midsole 26 is slit part way along its length to form upper and lower midsole layers 50 and 52. The slit is indicated at 48 in FIGS. 2 and 6 and extends forwardly from the back edges of the shoe's heel. The body portions 40 of tie members 36 are received in slit 48 between midsole layers 50 and 52. After tie members 36 are positioned in place in midsole 26, midsole layers 50 and 52 are adhered, bonded or otherwise suitably fixed together, thus fixing tie members 36 in place.

Instead of slitting midsole 26, small apertures 53 (FIG. 7) may be formed transversely through a one-piece midsole from one side to the other for receiving tie members 36. Apertures 53 may be formed by puncturing the midsole with the tie members to initiate precompression of the midsole.

In FIG. 8, the constrained, vertically loaded configuration of midsole 26 is shown in solid lines, and the unloaded configuration of the midsole is shown in phantom lines. In comparison with the constrained midsole configuration shown in FIG. 8, an unconstrained midsole 56 in the prior art configuration of FIG. 9 will expand outwardly along the edges of the shoe upon being vertically compressed under the wearer's load.

By constraining midsole 26 against transverse expansion with the constraint mechanism of this invention, the gas pressure in the closed cells of the midsole foam will increase faster than in the case in the unconstrained midsole 56 shown in FIG. 9. As compared with the unconstrained midsole 56, considerably more energy will therefore be absorbed per unit compression of midsole 26 and hence per unit penetration of the wearer's foot into the midsole. Furthermore, the peak force required to absorb a given amount of energy with the constrained midsole construction of this invention is significantly less than the peak force required to absorb the same amount of energy in the unconstrained midsole configuration of FIG. 9 as shown, for example, in FIG. 10.

FIG. 10 shows three force curves 60, 61 and 62, each being a plot of exerted or applied force (F) versus the distance (D) of foot penetration or the extent of midsole compression. Curve 60 represents the exerted force for midsole 26 which has been precompressed by a selected force magnitude $F_0$. Curve 61 represents the exerted force for the constrained midsole without any precompression. Curve 62 represents the exerted force for the unconstrained, prior art midsole 56 shown in FIG. 9. Midsole precompression as exemplified by curve 60 is in excess of any residual gas pressure in the closed cells of the foam.

The area under each of the curves 60–62 represents the amount of energy absorbed by the foamed midsole. In the example shown in FIG. 10, the areas $E_1$, $E_2$ and $E_3$ under curves 60–62 have been made equal to illustrate conditions for absorption of equal amounts of energy.

For the precompressed constrained foam embodiments of this invention (see FIG. 8, for example) midsole 26 must be compressed through a distance $D_1$ to absorb energy $E_1$, which is represented by the area under curve 60. To absorb the same amount of energy without precompressing the constrained midsole (see curve 61), the midsole must be compressed through a greater distance $D_2$. To absorb the same amount of energy with the prior art shoe of FIG. 9, the unconstrained midsole 56 must be compressed through a distance $D_3$ which is greater than distance $D_2$. As compared with the unconstrained midsole 56, the constrained midsole of this invention (whether precompressed or not) will therefore absorb more energy than the unconstrained midsole per unit compression of the midsole, thus making the constrained midsole of this invention more efficacious as an energy absorber.

When tie members 36 are adjusted to precompress or preload midsole 26, the precompressed midsole will absorb an even greater amount of energy per unit vertical compression of the midsole as compared with the other two conditions shown in FIG. 10. Precompression of midsole 26 therefore enhances the capability of the midsole to absorb energy to even a greater extent and thus makes it still more efficacious as an energy absorber.

As shown in FIG. 8, tie members 36 will flex to assure a bowed configuration as the wearer's foot penetrates into the midsole. If the force exerted by the wearer on midsole 26 is angularly offset from a vertical plane containing the shoe's longitudinal axis, as indicated, for example, by force vector $F_s$, the flexure of tie members 36 will be such that the constraint plate lying closest to the direction of the exerted force tends to be drawn down more than the other constrained plate, creating a greater midsole compression in the region of the first mentioned constraint plate than in the region of the second mentioned constraint plate. Therefore, the force acting to restore the first mentioned constraint plate to its original position will be greater than the force acting to restore the second mentioned constraint plate to its original position. For the illustrated direct of force $F_s$, the restoring force applied to plate 32 will be greater than the restoring force applied to plate 34 for re-establishing an equilibrium condition in which the magnitude of the forces acting on the plates are equal. This will also increase the shoe's stability.

In the embodiment shown in FIG. 11, a wedge type lock or fastening device is shown in place of the threaded construction illustrated in FIG. 5. In FIG. 11, each of the tie members 36 has a smooth cylindrical end section 70 loosely received in aperture 72 in plate 34. A wedge-shaped locking member 76 is wedged into aperture 72 to secure the tie member in its selectively adjusted position.

In the embodiment shown in FIG. 12, a bead and notch construction is shown for fixing each of the tie members 36 in its adjusted position. In this embodiment, the smooth cylindrical end section of each tie member 36 extends through an aperture 76 in plate 34 and is formed with a set of axially spaced apart circumferentially extending notches 78. The notched end portion of the tie member 36 extends through a bead 80 on the outer side of plate 34.

As shown in FIG. 13, bead 80 is interiorly formed with an indentation 82 which is adapted to seat in one of the notches 78 to secure the tie members in place. Bead 80 is formed from any suitable plastic material which is sufficiently elastically deformable to permit the bead's indentation 82 to be unseated from the notch in the end of the tie member by exerting an axially directed force on the bead. Thus, bead 80 may be selectively moved to different positions where it seats in any selected one of the notches 78, thereby selectively adjusting the precompression of midsole 26.

Other suitable fastening elements may be utilized to releasably fix tie members 36 in their adjusted positions.

Figure 7:
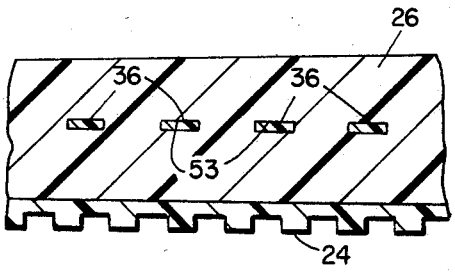
FIG. 7 is a section similar to FIG. 6, but showing a somewhat modified form of the midsole.
Figure 14:
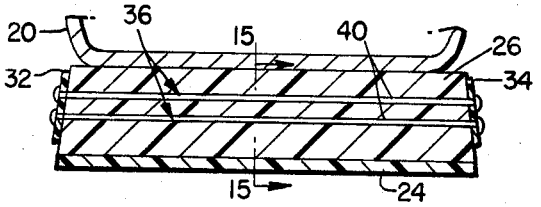
FIG. 14 is a section similar to FIG. 3, but showing another arrangement of the constraint plate tie members.
Figure 15:
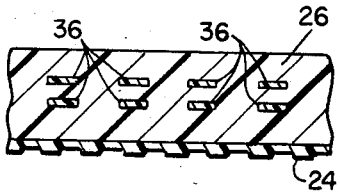
FIG. 15 is a section taken substantially along lines 15—15 of FIG. 14.

The embodiment shown in FIGS. 14 and 15 is the same as that shown in FIG. 7 except that tie members 36 are arranged in two parallel, spaced apart rows, one over the other.

Figure 16:
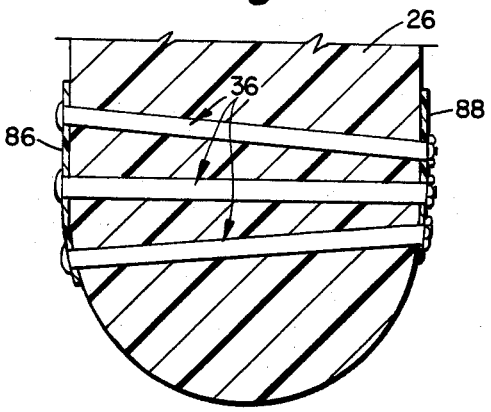
FIG. 16 is a section similar to FIG. 4, but showing yet another arrangement of the constraint plate tie members.

In the embodiment shown in FIG. 16, differently sized constraint plates 86 and 88 are used in place of constraint plates 32 and 34, and tie members 36 are arranged to converge toward one another in a direction extending from plate 86 to plate 88. The length of plate 88 is less than that of plate 86. Except for this difference in plate size, plates 86 and 88 are the same as plates 32 and 34.

The construction shown in FIG. 16 is particularly applicable for runners who pronate excessively. By locating the larger constraint plate 86 along the medial border of the sole unit and by converging tie members 36 towards the smaller constraint plate 88, greater support is provided along the shoe's medial border to counterbalance the greater load which is imposed on the medial border by runners who pronate. The extent of the support provided by plate 86 may be customized for particular runners by individually adjusting tie members 36 and/or selectively severing or otherwise eliminating selected tie members from the force system established by the midsole constraint mechanism.

Figure 17:
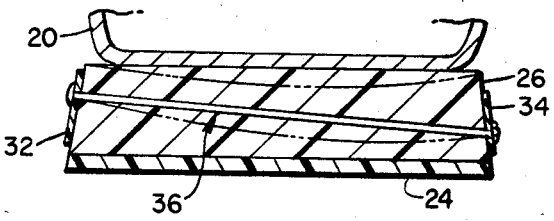
FIG. 17 is a section similar to FIG. 3, and showing still another tie member arrangement.

In the embodiment shown in FIG. 17, constraint plate 34 is placed at a lower level than plate 32 and tie members 36 intersect the plane of plate 32 above the plate's longitudinal or medial axis and slope downwardly to the central region of plate 34. The embodiment of FIG. 17 is otherwise the same as the one shown in FIGS. 1–6.

In the embodiment of FIG. 17, penetration of the wearer's foot into midsole 26 causes the upper portion of plate 32 to be drawn inwardly forcing the midsole to expand upwardly somewhat along the medial border of the shoe. This has the effect of enhancing the support for runners who pronate excessively.

Figure 18:
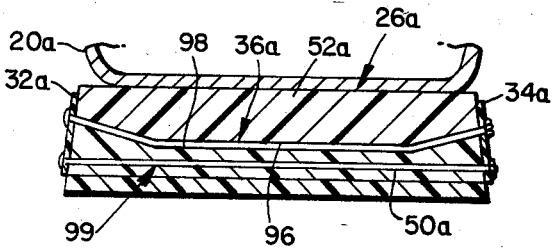
FIG. 18 is a section similar to FIG. 3, but showing still another embodiment of the constraint mechanism.
Figure 19:
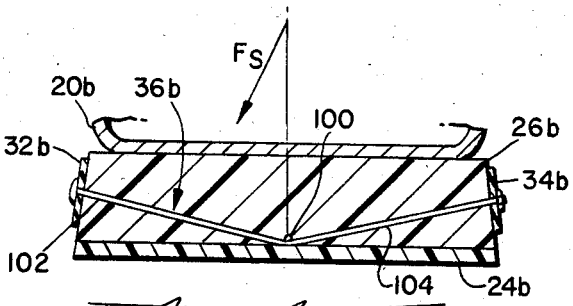
FIG. 19 is a section similar to FIG. 3, and showing still another tie member arrangement.

FIGS. 18 and 19 show modified constructions for enhancing the stability of the shoe.

To the extent that the embodiments of FIGS. 3 and 18 are similar, like reference numerals have been applied to designate similar parts, except that the reference numerals used for the embodiment of FIG. 18 have been suffixed by the letter "a" to distinguish them from the reference characters used for the embodiment of FIG. 3.

In the embodiment of FIG. 18, an additional row of tie members 99 may be employed for the interconnecting plates **32*a* and 34*a*. Tie members 99 may be the same as members 36*a***.

Tie members 99 extend through midsole layer **52*a* in a region underlying members 36*a*. In absence of a wearer-imposed load, tie members 99** are unflexed and lie along a common horizontal plane.

In FIG. 18, midsole layer **50*a* is formed with a downwardly projecting central body portion 96 which interfittingly seats in a mating recess 98 in midsole layer 52*a*. Tie members 36*a* are engaged and flexed downwardly by body portion 96 to seat in recess 98, thus drawing the constraint plates 32*a* and 34*a* inwardly and downwardly to precompress the lower midsole layer 52*a*. In FIG. 18, tie members 36*a* are flexed to lie at an angle relative to the horizontal plane of the shoe at the regions where they engage constraint plates 32 and 34*a*. As a result, the restoring forces due to midsole compression will also act as a corresponding angle to the horizontal plane to enhance the stability of the shoe during restoration to a equilibrium condition as explained more fully in the description for FIG. 19. FIG. 19** shows another embodiment in which the tie members are angled to enhance the stability of the shoe.

To the extent that the embodiment of FIG. 19 is the same or similar to the embodiment shown in FIG. 3, like reference numerals have been applied to designate like or similar parts, except that the reference numerals used for the embodiment of FIG. 19 have been suffixed by the letter "b" to distinguish them from the reference numerals used in the previously described embodiments.

As shown in FIG. 19, tie members **36*b* are fixed at their midpoints to the upper face of outsole 24*b* by suitable fasteners 100. By this arrangement, each tie member 36*b* is divided into two angled sections 102 and 104 lying on opposite sides of fastening device 100. Each section 102 and 104 slopes upwardly in a direction extending away from fastening device 100. In this embodiment, the sections 102 and 104 of tie members 36*b*** are symmetrically arranged about the vertical plane containing the shoe's rearquarter axis.

Due to the substantial acute angle which each of the sections 102 and 104 makes with the horizontal, an off center load or force $F_s$ will increase the midsole constraint on the side to which the force $F_s$ is angularly offset. Unbalanced constraint plate restoring force will therefore be developed, with the greater restoring force being situated on the side to which force $F_s$ is offset to enhance the stability of the shoe. In FIG. 19, force $F_s$ is offset in the direction of plate **32*b*. The restoring force acting on plate 32*b* will therefore be greater than the force acting on plate 34*b* to counterbalance force $F_s$. Because of the flexure of tie members 36*a* in FIG. 18, a similar stabilizing effect is produced in the embodiment of FIG. 18**.

Figure 20:
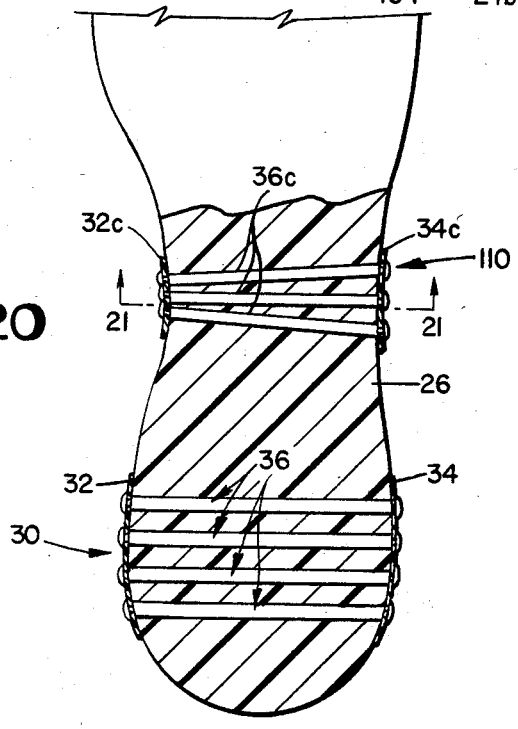
FIG. 20 is a section similar to FIG. 4, but illustrating still another embodiment wherein two sets of constraint plates are utilized for constraining the foamed midsole both in the rearfoot and midfoot regions of the shoe.
Figure 21:
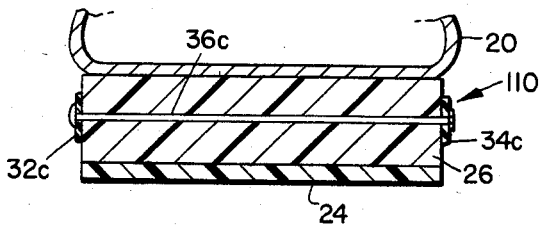
FIG. 21 is a section taken substantially along lines 21—21 of FIG. 20.

The embodiment shown in FIGS. 20 and 21 is the same as that shown in FIGS. 1–6 except that an additional constraint mechanism 110 has been added to constrain outward expansion of midsole 26 in the midfoot region. Constraint mechanism 110 is similar to constraint mechanism 30. Accordingly, like reference numerals have been applied to designate like or similar parts except that the reference numerals used for constraint mechanism 110 have been suffixed by the letter "c" to distinguish them from those used for the previous embodiments. Constraint mechanism 110 operates in the same manner as constraint mechanism 30.

As best shown in FIG. 20, constraint mechanism 30 and 110 are spaced apart longitudinally of the shoe with constraint mechanism 110 being located forwardly of constraint mechanism 30 to constrain outward expansion of the midsole's region underlying the wearer's midfoot. It will be appreciated that instead of being located in the midfoot region, constraint mechanism 110 may be located in the shoe's forefoot region. Alternatively, an additional constraint mechanism (not shown) of the type shown in FIG. 20 may be located in the forefoot region in addition to constraint mechanisms 30 and 110.

Figure 22:
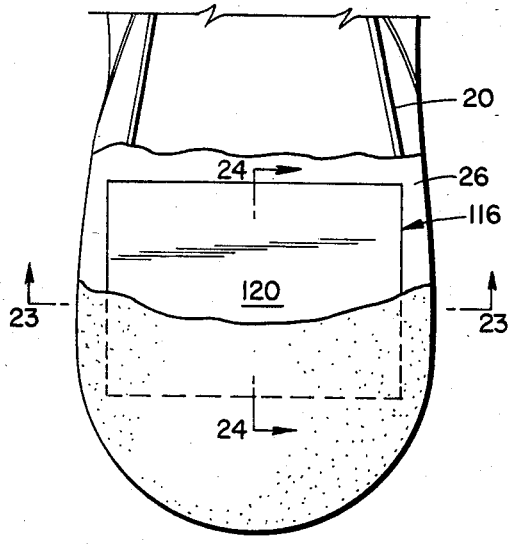
FIG. 22 is a top plan view of an athletic shoe incorporating yet another embodiment in which the tie member between the constraint plates is in the form of a plate.

Various other constraint mechanism embodiments may be used in the embodiment of FIGS. 21 and 22. For example, any selected one of the embodiments of FIGS. 16, 17, 18 and 19 may be employed in place of either one or both of the constraint mechanisms shown in FIG. 20.

Like the embodiments of FIGS. 1–6, the constraint plates in the embodiments of FIGS. 7–21 may be adhered or bonded to the shoe's midsole.

Figure 23:
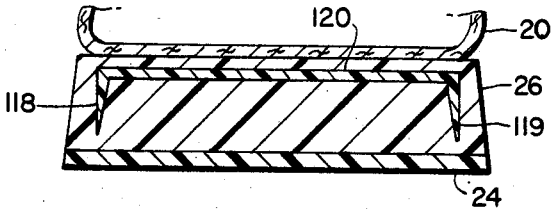
FIG. 23 is a section taken substantially along lines 23—23 of FIG. 22.
Figure 24:
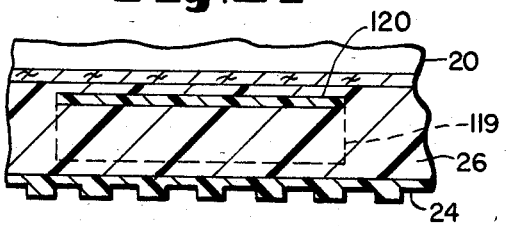
FIG. 24 is a section taken substantially along lines 24—24 of FIG. 22.

FIGS. 22–24 show a cantilever type midsole constraint mechanism 116 having a pair of parallel, spaced apart, longitudinally extending constraint plate portions 118 and 119 depending vertically in cantilever fashion from a horizontally extending nonstretchable, flat-sided cross piece or portion 120. Cross piece 120 functions as a tie member between plate portions 118 and 119 and may also function as an insole plate or board for the shoe.

Cross portion 120 preferably lies slightly below the interface between upper 20 and midsole 26. As shown, cross portion 120 extends between constraint plate portions 118 and 119 throughout the entire rearfoot region from one side of the sole to the other. Cross portion 120 may extend forwardly of the rearfoot region and may be configured to provide either a partial insole or a full insole. Plate portions 118 and 119 extend normal to and are integrally joined to cross portion 120.

As best shown in FIG. 23, plate portions 118 and 119 lie at the upper corners of the midsole's medial and later borders and protrude downwardly into midsole 26 to be embedded in the midsole. Cross portion 120 is thin enough to flex under the wearer's load. Plate portions 118 and 119 are thicker than cross portion 120 and therefore are relatively stiff to resist flexure due to compression of midsole 26 under the wearer's load. Thus, plate portions 118 and 119 function to constrain outward expansion of the midsole portion lying between plate portions 118 and 119. The lower free ends of plate portions 118 and 119 may lie at a common level above the bottom face of midsole 26.

Constraint device 116 may be formed from any suitable material. For example, it may be molded or otherwise formed as one piece from a suitable plastic material.

Constraint device 116 may be assembled with midsole 26 in any suitable manner. For example, the midsole may be molded around device 116.

In the embodiment shown in FIGS. 25–28, a pair of opposed, spaced apart constraint plate portions 130 and 131 are integrally joined to or otherwise suitably fixed to a horizontally extending, nonstretchable, dynamic reaction plate 132, such that plate 132 extends between and interconnects constraint plate portions 130 and 131. Plate 132 acts as a tie member for interconnecting constraint plate portions 130 and 131 and additionally functions to stiffen midsole 26 in a manner described in greater detail below. Constraint plate portions 130 and 131 are located along the midsole's lateral and medial borders in the midsole's rearfoot region to constrain outward expansion of the midsole in the rearfoot region.

Figure 28:
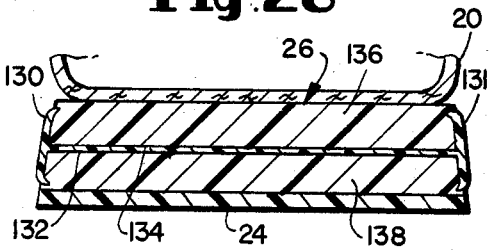
FIG. 28 is a section taken substantially along lines 28—28 of FIG. 25.

Referring to FIG. 28, midsole 26 is cut to form a horizontal slit 134 to partially divide midsole 26 into upper and lower layers 136 and 138. Slit 134 extends forwardly from the rear edge of the sole's heel portion. Plate 132 is received in slit 134 and is confined between the upper and lower midsole layers 136 and 138 and is glued or otherwise suitably adhered to the opposing surfaces of midsole layers 136 and 138 preferably throughout the entire interface between the plate and each midsole layer. Midsole layer 136 is preferably thick enough to keep the wearer's foot from bottoming out on plate 132. In this embodiment, plate 132 is flat-sided and is the same as the dynamic reaction plate described in assignee's copending application Ser. No. 456,820 filed Jan. 10, 1983 for Dynamic Support System for Athletic Shoes.

Figure 27:
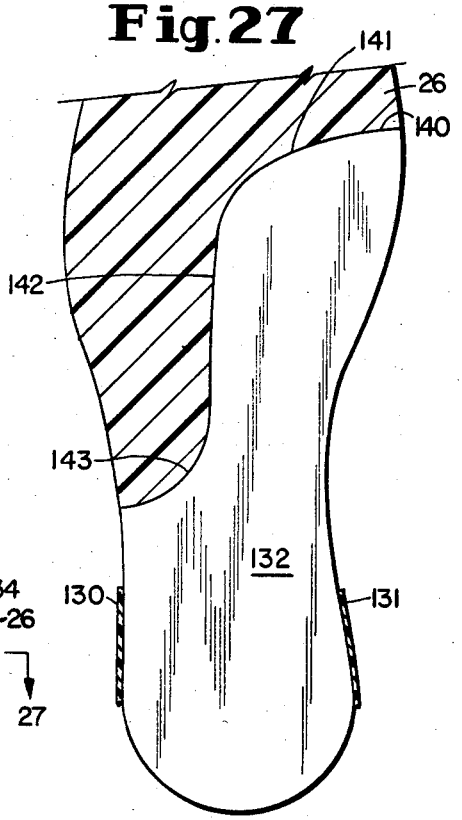
FIG. 27 is a section taken substantially along lines 27—27 of FIG. 25.
Figure 25:
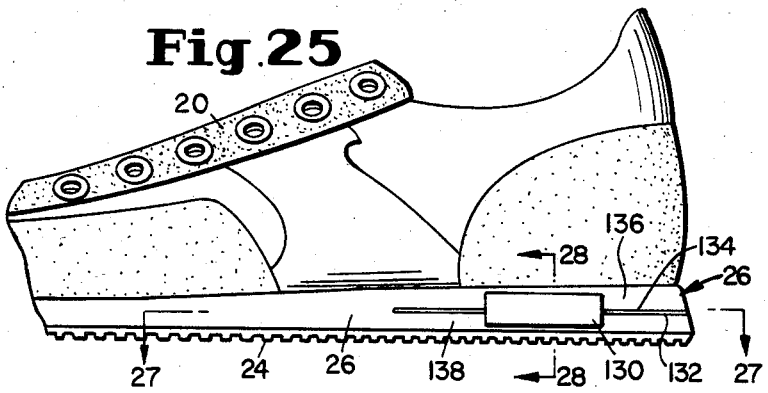
FIG. 25 is a left side elevation of a left foot athletic shoe incorporating yet another embodiment of this invention and embodying a midsole stiffening plate.
Figure 26:
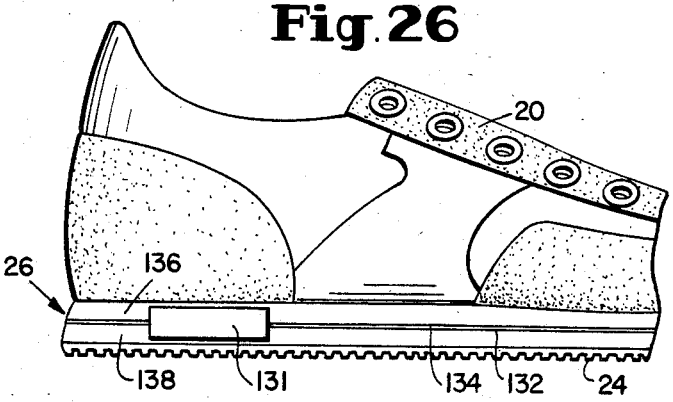
FIG. 26 is a fragmentary right side elevation of the athletic shoe shown in FIG. 25.

As best shown in FIG. 27, plate 130 extends throughout the rearfoot region of the shoe's sole to the outer edge of the heel and from one side of the midsole to the other. From the midsole's rearfoot region, plate 132 extends forwardly along the shoe's medial or inside border to a location 140 which is proximal to the wearer's first metatarsal head. From here, the edge or perimeter of plate 132 arcs posteriorly and and laterally along a line 141 which is proximal to the wearer's second and third metatarsal heads. The forward edge of plate 132 then turn to follow a direct longitudinally extending line 142 posteriorly to a region underlying the wearer's cuboid where it arcs out at 143 to extend laterally to the lateral or outer border of the shoe's sole.

From the foregoing description it is clear that plate 132 underlies the wearer's entire rearfoot and extends forwardly to underlie the wearer's inside arch along the medial border, but not the wearer's outside arch or the forefoot region extending forwardly of the wearer's first, second and third metatarsal heads. Plate 132 stiffens midsole 26 in the sense that midsole 26 is more difficult to flex in the region where the plate lies.

Because of the selected area covered by plate 132, however, the plate does not interfere with the required flexure of the shoe for running, walking or other normal activities. Plate 132 is considered to be semi-rigid rather than completely rigid in the sense that under a large enough force it will flex or bend rather than breaking.

Stiffening plate 132 and constraint plate portions 130 and 131 may be formed as one piece (as by molding) from any suitable, durable, nonstretchable stiff material such as a composite sheet of polyester resin containing woven or chopped fiberglass.

The upper midsole layer 136 will be nonuniformly compressed by the wearer's heel load upon impact on the ground to absorb some of the impact energy as the wearer's heel penetrates into the midsole. The lower midsole layer 138, however will be compressed more uniformly because of the stiffness of plate 132. The stiffer the plate is made, the less it will deflect under a given load. Thus, the stiffer plate 132 is made, the more evenly the wearer's heel load will be distributed over the underlying midsole layer 138 to more uniformly compress layer 138.

The more uniformly midsole layer 138 is compressed, the greater will be the reduction in nonuniform or localized degradation of the midsole layer. By reducing nonuniform degradation of the midsole layer 138, the shoe will remain stable for a longer period of usage thus lengthening the useful life of the shoe. The desired stiffness of plate 132 may be obtained by varying the plate's modulus of elasticity and/or by varying the plate's thickness.

In the embodiment shown in FIGS. 25–28, the shape and size of constraint plate portions 130 and 131 are the same as the shape and size of the constraint plates 32 and 34. Stiffening plate 132 is integrally joined to constraint plate portions 130 and 131 midway or about midway between the upper and lower edge of each of the constraint plate portions. Thus, as shown in FIG. 28, the upper halves of constraint plate portions 130 and 131 will seat against the lateral and medial borders of the upper midsole layer 136, and the lower halves of constraint plate portions 130 and 131 will seat against the lateral and medial borders of the lower midsole layer 138. Constraint plate portions 130 and 131 will therefore constrain outward expansion of both the midsole layers 136 and 138 in the rearfoot region. Constraint plate portions 130 and 131 may be adhered or bonded to the midsole's lateral and medial borders respectively.

The width of stiffening plate 132 between constraint plate portions 130 and 131 may be selected so that when the midsole is unloaded (see FIG. 28) constraint plate portions 130 and 131 will snugly seat against the midsole's lateral and medial borders without transversely precompressing the midsole. Alternatively, the width of stiffening plate 132 between constraint plate portions 130 and 131 may be made shorter, whereby the spacing between constraint plate portions 130 and 131 is such to precompress midsole 26 before the wearer's load is applied. Instead of having equal lengths as shown in FIG. 27, constraint plate portions 130 and 131 may be provided with dissimilar lengths similar to the embodiment shown in FIG. 16.

In the embodiment shown in FIGS. 25–28, stiffening plate 132 extends parallel to the ground surface or the ground-engaging bottom surface of outsole 24. Alternatively, stiffening plate 132 may be tilted or rotated in one direction or the other about a longitudinally extending axis. For example, plate 132 may be tilted in a direction to slope downwardly in a direction extending from the sole's medial or inside border to the sole's lateral or outside border to compensate for the forces which are created by runners who pronate excessively. Alternatively, stiffening plate 132 may be tilted in the opposite direction such that it slopes downwardly in a direction extending from the sole's lateral border to the sole's medial border to compensate for forces exerted by runners who supinate excessively.

Instead of being molded in one piece and thereafter slit to accommodate stiffening plate 132, midsole 26 may be manufactured with two separately formed foamed layers, and these layers may have different densities. Furthermore, stiffening plate 132 is not required to be flat-sided or planar and, instead, may be formed with differently shaped nonplanar or contoured configurations.

The embodiments shown in FIGS. 1–8, 11–18, 20–21 and 25–28 may be incorporated into the athletic shoe after the shoe is fully manufactured as a finished product to customize the shoe to an individual wearer. The method of incorporating the foregoing embodiments of the constraint mechanism into an existing or fully manufactured shoe comprises the steps of first slitting or otherwise forming a cavity in the foamed midsole of an existing athletic shoe to partially divide the midsole into upper and lower layers for receiving the constraint mechanism's tie member or members, as the case may be, then inserting the tie member or members into the slit or cavity between the midsole layers, and finally adhering the upper and lower midsole layers together to fix the tie member or members in place.

Figure 29:
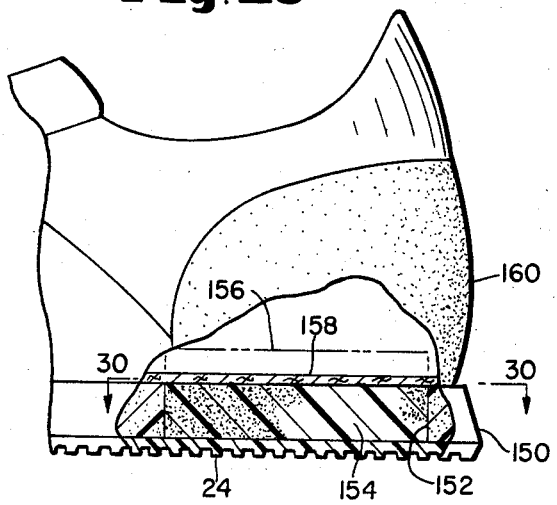
FIG. 29 is a side elevation of a left foot athletic shoe incorporating yet another embodiment of this invention, with portions of the shoe broken away to show details of the midsole structure.
Figure 30:
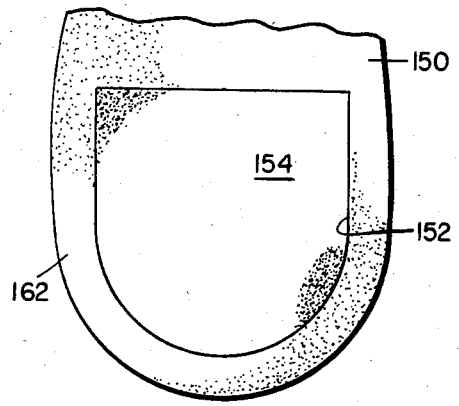
FIG. 30 is a section taken substantially along lines 30—30 of FIG. 29.

In the embodiment shown in FIGS. 29 and 30, the athletic shoe is provided with a modified midsole 150 having an enlarged vertical opening or aperture 152 underlying the central region of the wearer's heel or calcaneus for receiving an oversized, foamed midsole core 154. In this embodiment, aperture 152 is formed completely through the midsole from its top face to its bottom face. In its relaxed, uncompressed or undeformed condition, core 154 has a vertical length or dimension which is greater than the midsole thickness in the region of aperture 152.

The undeformed, uncompressed configuration of core 154 is shown by the phantom lines 156 in FIG. 29, Core 154 is dimensioned in horizontal cross section to be interfittingly received in aperture 152. After core 154 is inserted into aperture 152 it is compressed vertically downwardly to a level where the top face of core 154 lies flush or at least substantially flush with the top surface of midsole 150, thus precompressing core 154 into the midsole aperture 152.

An insole board 158 overlying core 154 and extending beyond aperture 152 is adhered or otherwise suitably fixed to midsole 150 to constrain and thus prevent upward expansion of core 154. In this embodiment, the athletic shoe has a boardlasted upper 160 which is formed with an open bottom at least in the rearfoot region and which is closed by insole board 158. Thus, the vertically precompressed core 154 is confined against vertical expansion between insole board 158 and the shoe's outsole 24. The dimensions of core 154 and aperture 152 are preselected whereby core 154 will be precompressed to a preselected magnitude upon being compressed into aperture 152.

As best shown in FIG. 30, midsole 150 is formed with a border portion 162 which defines aperture 154 and which circumferentially surrounds core 154 to constrain outward expansion of core 154. Core 154 may be formed from any suitable foamed, closed cell polymeric material such as the one previously mentioned for midsole 26. Midsole 150 may be formed from a closed cell polymeric foam material which is harder than core 154.

It is evident from the description thus far that by constraining outward expansion of core 154, core 154 will absorb more energy for a given distance of compression under the influence of an external load because as the core is compressed, the constraint acts to increase the gas pressure in the closed cells of the core's foam to an extent that is greater than the closed cell gas pressure increase in an unconstrained foam. Furthermore, the amount of energy absorbed per unit distance of compression by an external load is further increased by precompressing core 154 to increase the core's closed cell gas pressure before an external load (such as the wearer's weight) is applied. In this embodiment, and the two embodiments to follow, precompression is established by a vertically applied force (that is, a force normal to the top face of the midsole) rather than a horizontal or transverse force.

Figure 31:
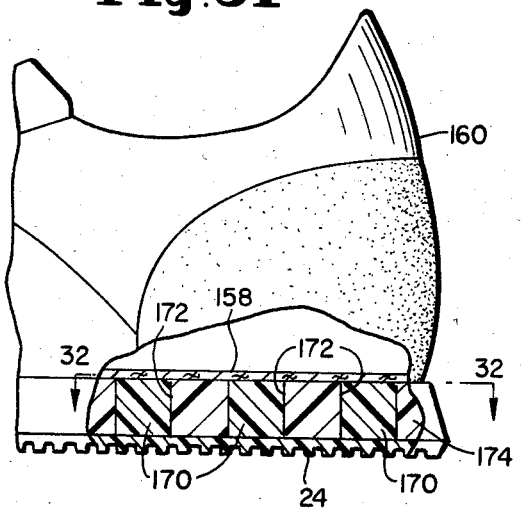
FIG. 31 is a side elevation of a left foot athletic shoe incorporating yet another embodiment of this invention, with portions of the shoe broken away to shoe details of the midsole structure.
Figure 32:
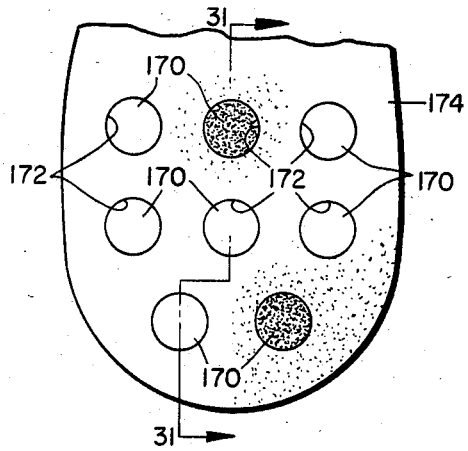
FIG. 32 is a section taken substantially along lines 32—32 of FIG. 31.

In the embodiment shown in FIGS. 31 and 32, core 154 is replaced by a set of smaller foamed cores 170 which are coaxially received in and vertically compressed into apertures 172 in midsole 174. Midsole 174 and cores 170 may be formed from any suitable foamed, closed cell polymeric material such as the one previously mentioned for midsole 26. Midsole 174 may be formed from a foamed material which is harder than the foamed material used for cores 170. Midsole 174 constrains outward expansion of cores 170 in a horizontal direction.

In the embodiment of FIGS. 31 and 32, cores 170 are in the form of cylindrical plugs. Apertures 172 are formed vertically through midsole 174 and are spaced apart in any suitable, preselected pattern in the region underlying the wearer's rearfoot. The longitudinal axes of apertures 172 are parallel and extend normal or substantially normal to the bottom flat face of midsole 174. Apertures 172 may be provided with uniform and equal diameters.

Cores 170 may be uniformly dimensioned and are provided with a common uncompressed length or height which is greater than the height or longitudinal dimension of apertures 172. In their relaxed, uncompressed states cores 170 may be provided with diameters which are substantially equal to the diameters of apertures 172. After being inserted into their respective apertures 172, cores 170 are compressed vertically downwardly to a level where the top faces of cores 170 lie flush with the top face of midsole 174.

Similar to the embodiment of FIGS. 29 and 39, insole board 158 overlies cores 170 and is adhered or otherwise suitably fixed to midsole 174 to prevent upward expansion of cores 170. The precompressed cores 170 are therefore confined against vertical expansion between insole board 158 and the shoe's outsole 24. The precompressed cores enhance the energy absorbing capability of the midsole structure similar to the embodiment of FIGS. 29 and 30.

Figure 33:
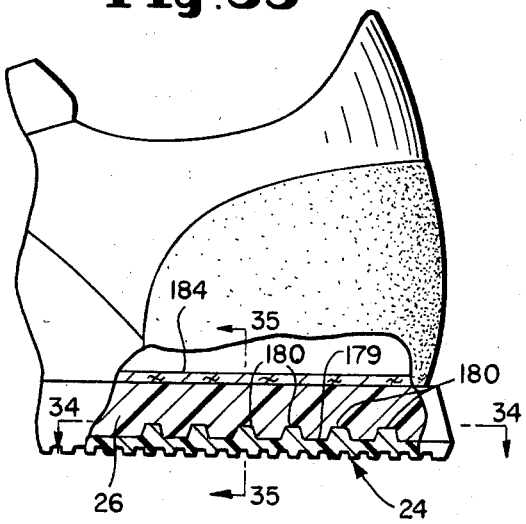
FIG. 33 is a left side elevation of a left foot athletic shoe incorporating still another embodiment of this invention with portions of the shoe broken away to illustrate details of the sole structure.
Figure 34:
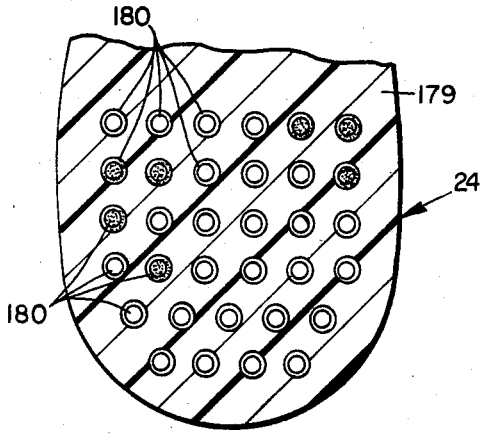
FIG. 34 is a section taken substantially along lines 34—34 of FIG. 33.
Figure 35:
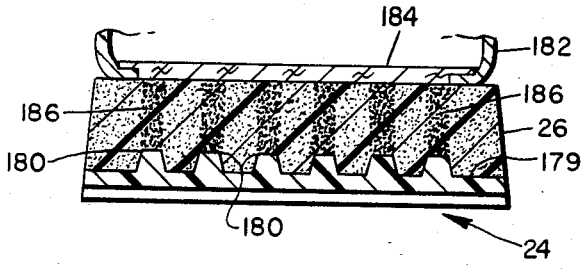
FIG. 35 is a section taken substantially along lines 35—35 of FIG. 33.

In the embodiment shown in FIGS. 33–35, outsole 24 is integrally formed with a flat-sided base portion 179 and an array of uniformly spaced apart nubs or short posts 180 which extend upwardly from the top face of base portion 179 in the region underlying the wearer's rearfoot. Nubs 180 may be uniformly dimensioned and may be uniformly distributed throughout the rearfoot region of the sole. As shown, nubs 180 terminate in flat end faces and penetrate upwardly into midsole 26. Nubs 180 may be conically contoured as shown. Alternatively, they may be hemispheres.

In this embodiment, the athletic shoe is of the board-lasted type having an upper 182 which is open along its bottom at least in the rearfoot region and which is closed by an insole board 184 such that midsole 26 is confined between insole board 184 and outsole 24. Thus, upward penetration of nubs 180 into midsole 26 results in the precompression of parallel spaced apart columns 186 of the midsole. The precompressed midsole columns are aligned with and vertically overlie nubs 180 and are perpendicular to the flat bottom of midsole 26. The precompressed midsole columns 186 enhance the energy absorbing capability of the midsole.

The midsole constraint mechanisms of this invention may be employed to compensate for leg and/or foot asymmetries. For example, the wearer's right limb may be longer than his or her left limb by a length $\Delta L$ as shown in FIG. 36.

Figure 36:
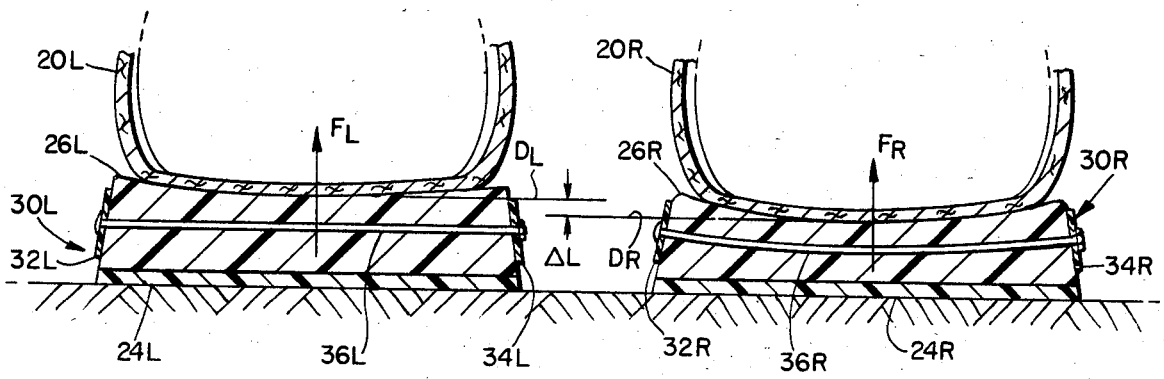
FIG. 36 is a transverse cross section (similar to FIG. 3) of both the left foot and right foot shoes to illustrate the manner in which the subject invention can be used to compensate for limb asymmetries.

Referring to FIG. 36, left foot and right foot shoes are shown in transverse cross section (similar to FIG. 3) and are the same as the one shown in FIGS. 1–6. Like reference numerals have therefore been used to designate like parts of the athletic shoes except that the reference numerals for the left foot shoe in FIG. 36 have been suffixed by the letter "L" and the reference numerals used for the right foot shoe in FIG. 36 have been suffixed by the letter "R."

Constraint mechanism 30R may be adjusted to provide zero midsole precompression or a midsole precompression of a preselected magnitude. The constraint mechanism 30L for the left foot shoe is adjusted to precompress midsole 26L to an extent which exceeds the precompression of midsole 26R by a preselected magnitude which is a function of the leg asymmetry $\Delta L$. In this example it will be assumed that the loads exerted by the wearer's right and left feet on midsoles 26L and 26R are equal.

Figure 6:
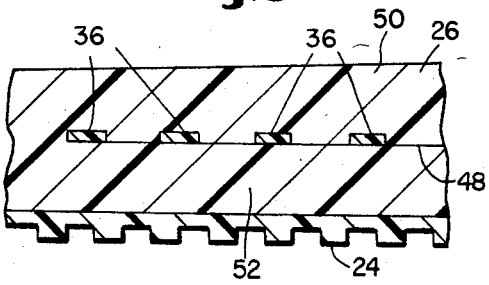
FIG. 6 is a section as seen from lines 6—6 of FIG. 4.

Because midsole 26L is precompressed to a greater extent than midsole 26R, the extent to which midsole 26L is compressed under the influence of the wearer's left foot load is less than the extent to which midsole 26R is compressed under the wearer's right foot load. The difference in compression of the two midsoles is selected to be equal to the leg asymmetry $\Delta L$, whereby midsole 26L will support the wearer's left foot at a level $D_L$, which is higher than the level $D_R$ at which midsole 26R supports the wearer's right foot upon reaching an equilibrium condition where the midsole restoring forces $F_L$ and $F_R$ (which may be regarded as the midsoles' spring forces) are equal. As shown, the difference in precompression between the two midsoles is such that the difference between the two support levels $D_L$ and $D_R$ for the equilibrium condition shown in FIG. 6 is equal to the difference in limb lengths, that is, $\Delta L$. It will be appreciated that other constraint mechanism embodiments of this invention may be utilized in place of constraint mechanisms 30L and 30R to achieve this same result.

It will be appreciated that precompression of a closed cell foamed midsole in accordance with this invention is in excess of any residual gas pressure which may exist in the closed cells of the foam after the foam is blown. In the specification, the term "rearfoot" is used to identify the heel portion of the foot containing the heel bone (the calcaneus) and the talus, the term "midfoot" is used to identify the intermediate portion of the foot lying between the rearfoot and the forefoot and containing the cuboid, the navicular and the cuneiforms, and the term "forefoot" is used to identify the foot portions lying forwardly of the midfoot and containing the metatarsals and the toes.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In an athletic shoe having a flexible outsole and a foamed, closed cell, polymeric intermediate sole structure overlying said outsole for cushioning the wearer's foot, a pair of opposing spaced apart constraint plates seated against the oppositely facing side borders of said intermediate sole structure, a substantial portion of said intermediate sole structure lying between said plates, and tie means engaging said plates to cause said plates to constrain outward lateral expansion of said portion upon vertical compression thereof by a wearer applied load.

2. The athletic shoe defined in claim 1 wherein said plates are sufficiently stiff to resist flexure by the forces developed by the compression of the intermediate sole structure under the wearer's load.

3. The athletic shoe defined in claim 1, wherein said tie means comprises means for selectively adjusting the spacing between said plates to variably precompress the intermediate sole structure between said plates.

4. The athletic shoe defined in claim 1 wherein said tie means includes a plurality of elongated tie members providing a force-transmitting connection between said plates and extending transversely of said plates in the region underlying the wearer's rearfoot, said members being placed in tension to compressively preload said portion of said intermediate sole structure.

5. In an athletic shoe having a flexible outsole and an intermediate sole overlying said outsole and formed from a foamed polymeric material having closed gas filled cells, the improvement comprising a pair of opposed, spaced apart constraint formations extending lengthwise of the intermediate sole and lying against the opposite sides thereof such that a substantial portion of said intermediate sole is confined between said constraint formations, and tie means providing a connection between said formations to restrain movement of said formations away from each other and to thereby cause said formations to constrain outward expansion of said portion upon compression of said portion by a wearer-applied load.

6. The athletic shoe defined in claim 5 wherein said constraint formations are plates.

7. The athletic shoe defined in claim 5 wherein said constraint formations seat against the exterior lateral and medial side borders of said intermediate sole, and wherein said constraint formations are formed separately from one another, and wherein said tie means engages said formations and comprises a plurality of elongated tie members extending transversely between said constraint formations, said tie members being tensioned by forces developed by the compression of the intermediate sole by a wearer-applied load to restrain movement of said formations away from one another.

8. The athletic shoe defined in claim 7 wherein said constraint formations are plates.

9. The athletic shoe defined in in claim 7, there being first means on each tie member and engaging one of said constraint formations, and second means on each tie member and engaging the other of said constraint formations and cooperating with said first means to limit displacement of said constraint formations away from each other as the intermediate sole is compressed by a wearer-applied load.

10. The athletic shoe defined in claim 9 wherein said first means is a threaded portion of the associated tie member, said threaded portion being threadedly engaged with said one of said constraint formations.

11. The athletic shoe defined in claim 7 wherein said intermediate sole is divided into upper and lower layers in the region of said portion, and wherein said tie members are flexible and are sandwiched between said upper and lower layers.

12. The athletic shoe defined in claim 7 wherein said tie members are flexible, extend through said portion of said intermediate sole, and are formed from a stretch-resistant material.

13. The athletic shoe defined in claim 7 wherein said tie members are flat-sided strips.

14. The athletic shoe defined in claim 7 wherein said tie members are formed from a stretch-resistant material, and wherein each of said tie members has a flexible body portion extending between said constraint formations in the region occupied by said portion of said intermediate sole.

15. The athletic shoe defined in claim 7 wherein said tie members are spaced apart from one another and lie along a common plane.

16. The athletic shoe defined in claim 7 wherein said tie members lie at least in the region of said intermediate sole underlying the wearer's rearfoot.

17. The athletic shoe defined in claim 7 wherein said tie means has means for selectively adjusting the spacing between said plates to provide an adjustable precompression of said portion of said intermediate sole.

18. The athletic shoe defined in claim 5 wherein one of said constraint formations seats against the exterior lateral side border of said intermediate sole, and wherein the other of said constraint formations seats against the exterior medial side border of said intermediate sole.

19. In an athletic shoe having a flexible outsole and an intermediate sole overlying said outsole and formed from a foamed, closed cell, polymeric material, the improvement comprising a pair of opposed spaced apart constraint plates, one of said constraint plates being seated against the exterior lateral side border of said intermediate sole, and the other of said constraint formations being seated against the exterior medial side border of said intermediate sole, said intermediate sole being at least partially divided to define an upper layer and a lower layer underlying said upper layer, and a stretch-resistant formation sandwiched between said layers and extending between said constraint plates, said constraint plates being joined to said formation to constrain outward expansion of said intermediate sole in the region lying between said constraint plates.

20. The athletic shoe defined in claim 19 wherein said formation is stiff and extends at least in the region underlying the wearer's rearfoot to stiffen the intermediate sole in the region underlying the wearer's rearfoot.

* * * * *

UNITED STATES PATENT AND TRADEMARK OFFICE

CERTIFICATE OF CORRECTION

PATENT NO. : 4,598,487

DATED : July 8, 1986

INVENTOR(S) : Kenneth W. Misevich

It is certified that error appears in the above-identified patent and that said Letters Patent is hereby corrected as shown below:

In the assignment data, change "Colgate-Palmolive Company, New York, N.Y." to --TRETORN AB, Helsingborg, Sweden--.

Signed and Sealed this

Thirteenth Day of January, 1987

*Attest:*

DONALD J. QUIGG

*Attesting Officer*

*Commissioner of Patents and Trademarks*